United States Patent [19]

Lepisto

[11] Patent Number: 4,471,820

[45] Date of Patent: Sep. 18, 1984

[54] VALVE BAG FILLING NOZZLE

[76] Inventor: J. George Lepisto, 2025 Winona Dr., Middletown, Ohio 45042

[21] Appl. No.: 422,868

[22] Filed: Sep. 24, 1982

[51] Int. Cl.[3] ..... B65B 1/18

[52] U.S. Cl. ..... 141/89; 141/10

[58] Field of Search ..... 141/10, 65, 68, 114–117, 141/119, 313–317, 85, 89, 91, 93

[56] References Cited

U.S. PATENT DOCUMENTS

| | | | |
|---|---|---|---|
| 3,072,208 | 1/1963 | Titchenal et al. | 141/68 X |
| 3,118,474 | 1/1964 | Eppolito | 141/68 |
| 3,137,328 | 6/1964 | Swenson et al. | 141/315 |
| 3,258,041 | 6/1966 | Lau | 141/10 |
| 4,219,054 | 8/1980 | Carter et al. | 141/10 |

*Primary Examiner*—Stephen Marcus

*Assistant Examiner*—Mark Thronson

*Attorney, Agent, or Firm*—Evelyn M. Sommer

[57] ABSTRACT

A filling nozzle for use in filling a valve bag eliminates sifting of product during the filling process. The nozzle has an air conduit that supplies high pressure air to clear the nozzle of product after a bag has been filled. An air conduit for low pressure air is provided to introduce air between the nozzle and the bag's valve sleeve for suspending any particles remaining in the valve sleeve after the bag has been filled. A vacuum suction passage is provided to withdraw the suspended particles from the valve sleeve. The nozzle can be used in conjunction with a slitted valve sleeve. The discharge end of the nozzle directs the flow of product downwardly through the slit in the valve sleeve and into the interior of the bag.

6 Claims, 5 Drawing Figures

VALVE BAG FILLING NOZZLE

BACKGROUND OF THE INVENTION

The present invention relates to the filling of valve bags with particulate material and, more particularly, to a novel filling nozzle which eliminates the sifting of product from the valve bag during and after the bag filling operation.

Particulate materials are commonly packaged in bags that are made from multiple layers of paper and have a "valve" in one upper corner. The valve provides an opening through which the material is dispensed during the bag filling operation. The valve bag is typically filled by inserting a spout or nozzle into the valve and causing material to flow through the nozzle into the bag. When the bag is full, the flow of material is halted and the nozzle is withdrawn from the valve usually by moving the bag away from the nozzle. The valve is sealed to prevent egress of the material from the bag during shipping and handling.

The spout of the present invention is particularly suited for use in conjunction with the filler sleeve disclosed in co-pending U.S. patent application Ser. No. 300,038, now U.S. Pat. No. 4,387,749, filed Sept. 8, 1981. The filler sleeve comprises an elongated tubular member which is connected to the top end of the bag. The tubular member includes an open end which is contiguous with a filler opening provided in the top end of the bag. The opposed end of the tubular member is closed, e.g. by heat sealing or folding. A longitudinally extending slit is provided in the tubular member disposed on the bottom surface thereof. In use, when the bag is filled by introducing the product by air flow or by gravity through a filler nozzle which is inserted into the filler opening and into the tubular member, the product is deflected downwardly into the bag thereby inhibiting the likelihood of blow-out of the side panels. Preferably, the tubular member is formed from a stretchable material such as polyethylene, so that during the filling of the bag the flow of the product stretches the material. By this arrangement, when the filling is completed, and the bag is inverted, the side edges of the slit, which have been stretched, overlap and the weight of the product functions to maintain the overlapping relationship thereby preventing the unwanted escape of product from the bag.

While the filling nozzle of the present invention is particularly suited for use with the slitted filler sleeve disclosed in the aforementioned co-pending application, those skilled in the art will appreciate that the present filling nozzle is also adaptable for use in conventional valve bags.

In filling valve bags, problems have been encountered in reducing or eliminating the sifting and dusting problems which occur. Typically, some amount of product will spill from the filling nozzle on its way into the bag or on its withdraw from the bag. Various hazardous products, such as toxic chemicals, clay, limestone, cement, carbon black, herbicides, fungicides, and the like are usually packaged in valve bags and the elimination of product sifting and dusting problems during the filling operation is therefore imperative. The slitted sleeve enhances bag performance and effectively reduces dusting, but does not completely eliminate the problem. Further, sifting can occur after the filling process is completed, e.g. during transit, if material is entrapped in the valve during the filling process. Such entrapment of material can occur if the filling nozzle does not directly discharge product through the slitted sleeve. Material can also become entrapped if product dribbles out of the nozzle into the sleeve at the end of the filling cycle.

It would be advantageous to provide a filling nozzle for a valve bag which directs the flow of product downwardly into the bag, thereby avoiding the direct discharge of product into the back end of the valve bag sleeve. It would be further advantageous if such a filling nozzle included a purge system to clear the nozzle of all product after a bag has been filled, to substantially reduce product dribble out of the nozzle, and to clear any product from the valve sleeve which remains after the bag has been filled.

This invention relates to such a filling nozzle.

SUMMARY OF THE INVENTION

A filling nozzle is provided for filling a valve bag. The nozzle comprises an elongated tube having a material passage therethrough. Means are provided for coupling one end of the material passage to a source of flowing particulate material. Low pressure conduit means runs along the tube for transmitting air under low pressure therethrough. Means for coupling the low pressure conduit means to a source of low pressure air, along with means for venting low pressure air from the low pressure conduit means through a port on the external surface of the tube are provided. A vacuum suction passage communicates with the material passage, and means are provided for coupling the vacuum suction passage to a source of vacuum. A high pressure conduit means is provided in communication with the material passage, along with means for coupling the high pressure conduit means to a source of high pressure air. An inflatable boot can optionally be provided on the filling nozzle to seal the nozzle within a valve sleeve during the bag filling operation.

In order to fill a valve bag, the bag is placed on the filling nozzle. The boot, if provided, is expanded to seal the nozzle within the valve sleeve. Product is then caused to flow through the material passage in the nozzle to fill the bag. After the bag is filled, the product flow stops and high pressure air is injected into the material passage within the nozzle to clear excess product therefrom. Low pressure air is then injected outside of the nozzle to suspend product dribblings in the valve sleeve. A vacuum is then applied to the vacuum suction passage to remove the dribblings suspended in the valve sleeve.

DETAILED DESCRIPTION OF THE INVENTION

Figure 1:
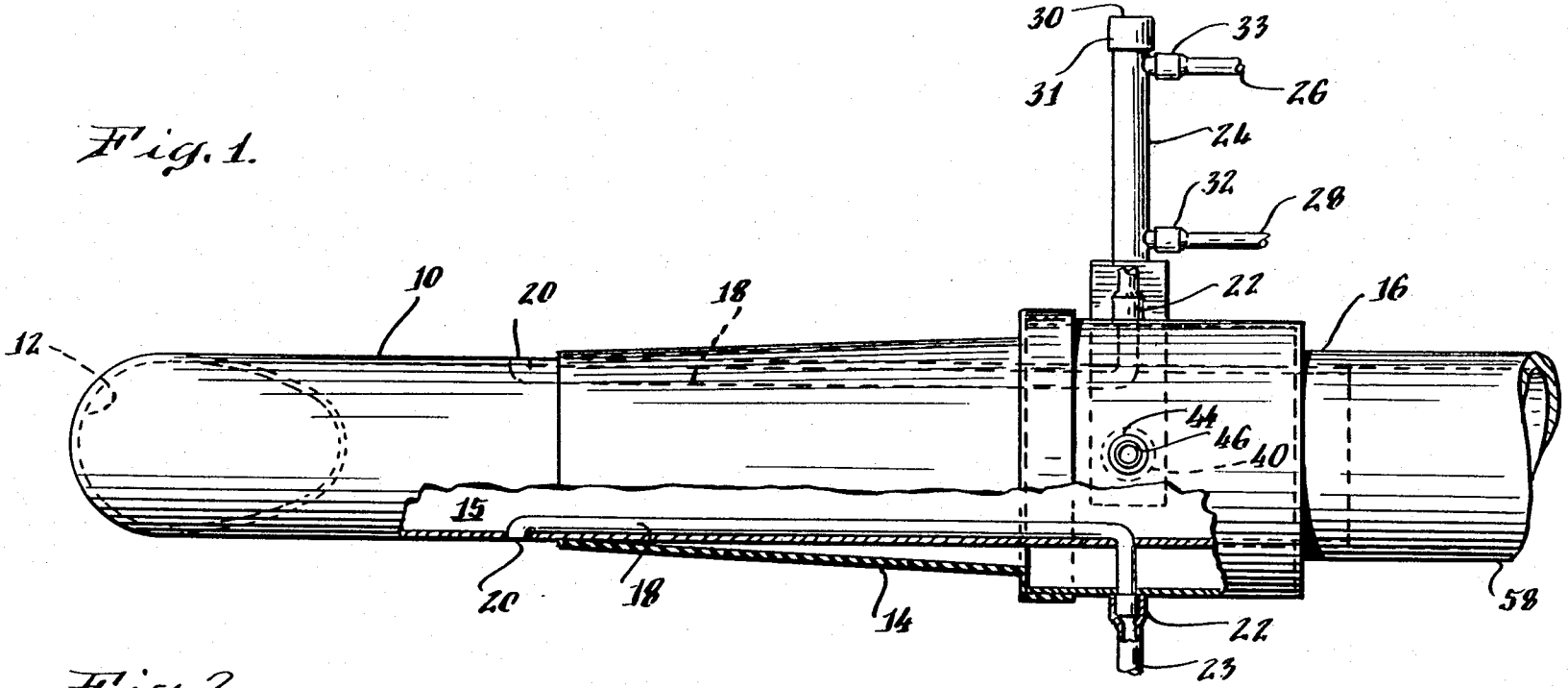
FIG. 1 is a top plan view, with partial cut-away, showing a filling nozzle in accordance with the present invention.
Figure 2:
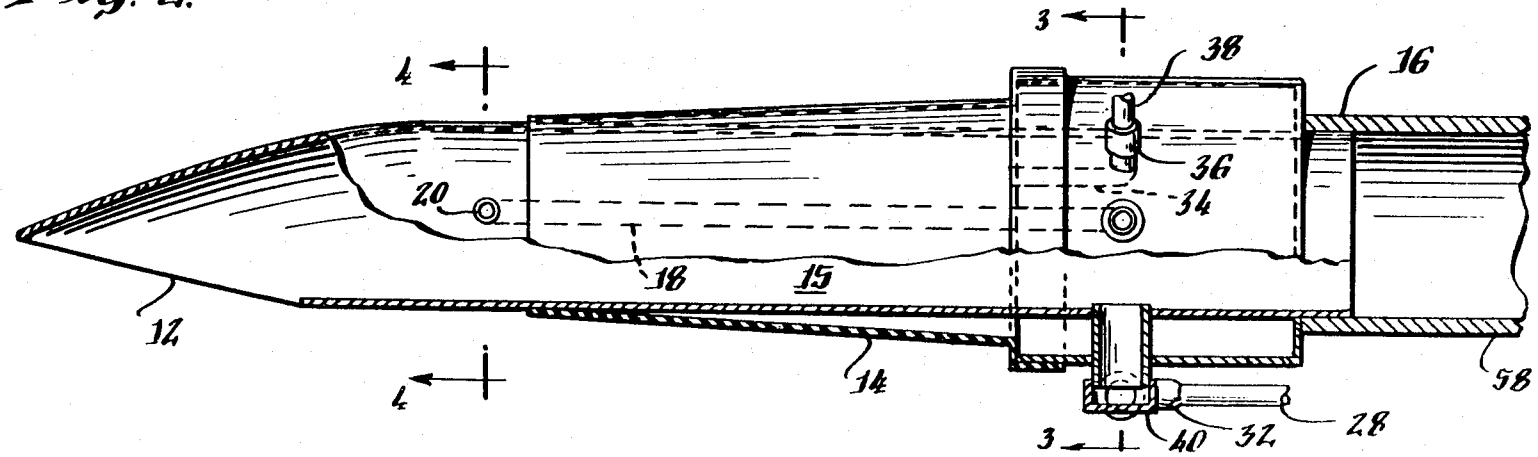
FIG. 2 is a side plan view, with partial cut-away, of the nozzle shown in FIG. 1.
Figure 5:
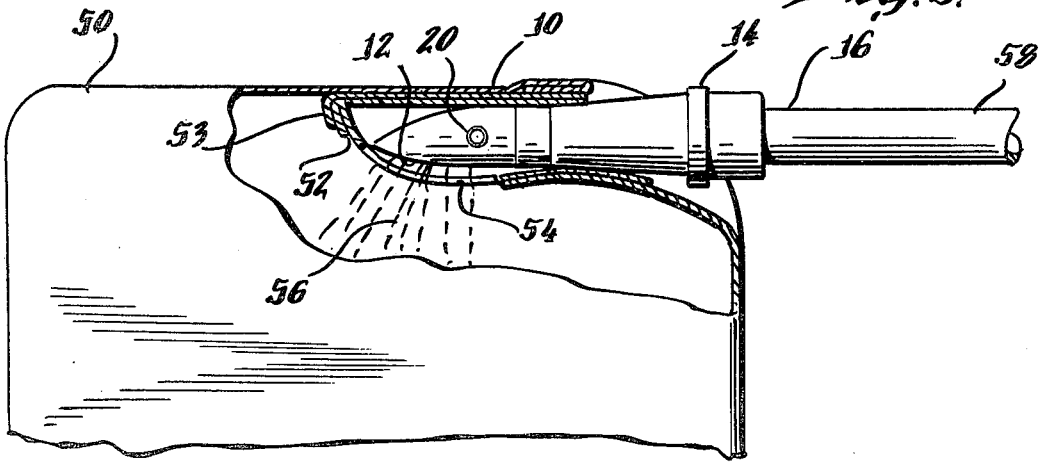
FIG. 5 is a cross-sectional view showing a nozzle in accordance with the present invention filling a valve bag through a slitted valve sleeve.

The overall structure of the filling nozzle of the present invention is best shown in FIGS. 1 and 2. The nozzle includes an elongated tube 10 which is hollow to provide a material passage 15 therethrough. In filling a valve bag, the nozzle is inserted into the bag as shown in FIG. 5. Product flows into end 16 of the nozzle through product supply conduit 58. The product, which is typically a particulate material, emerges from the nozzle through opening 12. The valve bag shown in FIG. 5 includes a valve sleeve 52 having a slit 54 therein through which particulate material 56 passes. Once particulate material 56 has passed through slit 54, it is within the interior of bag 50.

In valve bag filling nozzles of prior design, the opening at which the particulate product emerges for filling the bag is not designed to direct the flow of material exiting therefrom through a slitted valve sleeve. When such prior nozzles are used in conjunction with a slitted sleeve, such as sleeve 52 shown in FIG. 5, product is forced into the closed end 53 of sleeve 52 where it can become lodged or otherwise remain after the filling of the bag has been completed. Product remaining at end 53 of valve sleeve 52 can later find its way out of the valve sleeve, causing the material (which may be hazardous or toxic) to exit from the bag. Any such leakage of product from the bag is highly undesirable. Further, nozzles of prior design can cause the closed end 53 of valve sleeve 52 to rupture due to the direct force of material which impacts the closed end.

In the filling nozzle of the present invention, opening 12 is situated so that when the nozzle is inserted into a slitted valve sleeve, the product flowing through the nozzle will be directed through the slit and into the bag, thereby minimizing the risk that the product will be caught in the closed end of the valve sleeve. The design of opening 12, by directing product downwardly, also prevents the rupture of the closed end of the valve sleeve.

The filling nozzle of the present invention also includes various means for clearing the nozzle of residual particulate material after the product flow has ceased, and for removing any particulate material which may otherwise remain in the valve sleeve after the bag has been filled. Also provided is means for sealing the nozzle within the valve sleeve of a bag during the filling operation.

Figure 3:
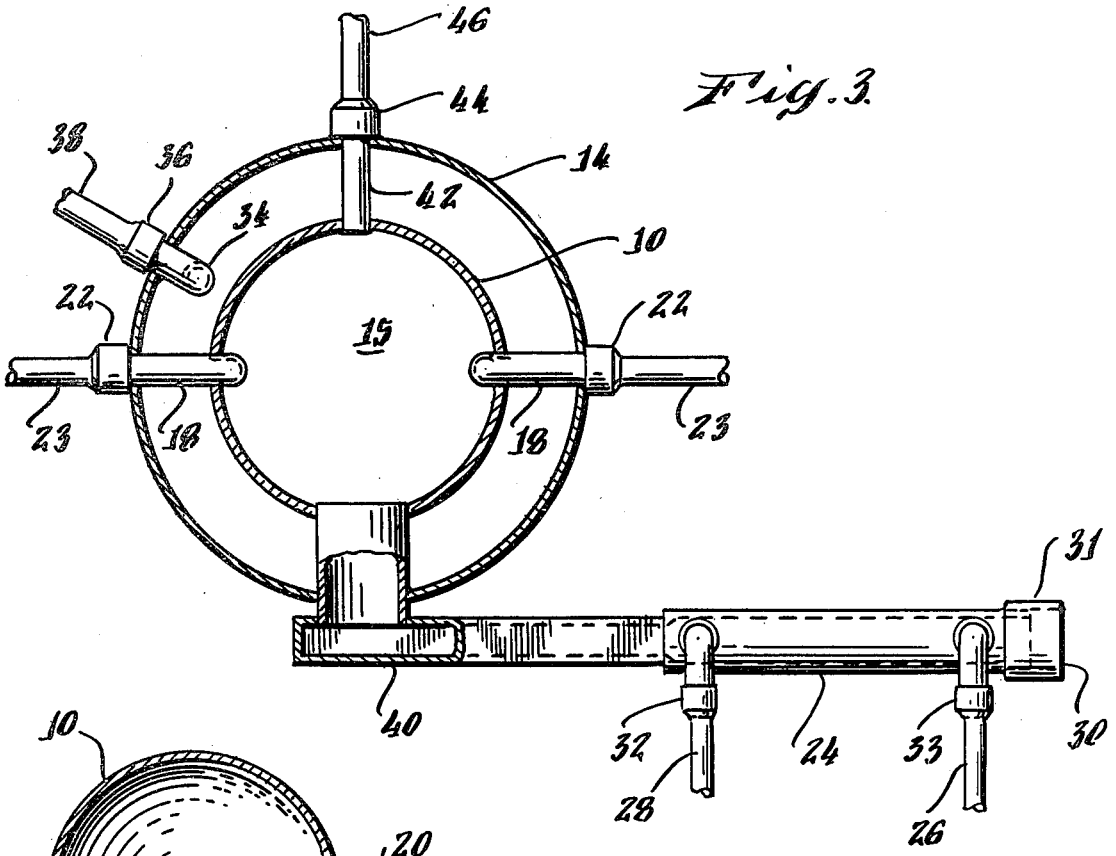
FIG. 3 is a cross-sectional view taken substantially along the line 3—3 shown in FIG. 2.

The sealing of the nozzle within a valve sleeve is accomplished by an inflatable rubber boot 14. Rubber boot 14 is inflated by a pressurized fluid, for example, pressurized air, which is introduced to the boot through a conduit 34. Conduit 34 is most clearly shown in FIGS. 2 and 3, and is connected to a hose 38 by coupling 36. Hose 38 is fed by a timed source of pressurized air (not shown) which is caused by suitable control means to inflate rubber boot 14 just after the nozzle is inserted into an empty valve bag, and to deflate rubber boot 14 just prior to the removal of the filled bag from the nozzle. The pressure used to inflate boot 14 will typically be on the order of 3 to 5 pounds per square inch.

After a bag has been filled with product flowing through the nozzle, and prior to the removal of the filled bag from the nozzle, a blast of high pressure air is introduced into material passage 15 of the nozzle to clear the nozzle of any particulate material remaining therein. The blast of high pressure air is passed through hose 46 to conduit 42. Hose 46 is coupled to conduit 42 by coupling 44. In the operation of the filling spout, the blast of high pressure air will typically be at a pressure on the order of 100 pounds per square inch.

After the high pressure blast clears material passage 15 of any remaining product, low pressure air at a pressure on the order of 50 pounds per square inch is introduced between the nozzle and the valve sleeve at ports 20. The low pressure air is carried to ports 20 by conduits 18. Conduits 18 are coupled, through couplings 22, to hoses 23 which carry the low pressure air. The term "low pressure" is used in describing this air source simply to differentiate it from the high pressure burst of air which is introduced into material passage 15 by conduit 42 and is used to clear material passage 15 of extraneous particulate material after a bag has been filled.

The purpose of providing a burst of low pressure air between the nozzle and the valve sleeve into which the nozzle is inserted is to suspend any particulate product material remaining in the bag sleeve after the bag has been filled. Any such particles remaining in the valve sleeve after the bag has been filled are referred to as 'dribblings'. After the dribblings have been suspended, a vacuum is drawn through conduit 40. Conduit 40 is a vacuum suction passage which communicates with material passasge 15. The vacuum is drawn as the nozzle is being removed from the bag, and as a result any suspended dribblings are sucked into material passage 15, and through conduit 40 to effect their removal from the bag. When the nozzle is used in conjunction with a slitted valve sleeve, as shown in FIG. 5, the internal pressure of the aerated product in the filled bag forces the slit to close, thereby preventing the vacuum within material passage 15 from sucking any product (other than dribblings) out of the filled bag. Thus, slit 54 can be analogized to a one way valve, which allows product to enter, but not exit from the bag.

In order to effect proper timing of the vacuum which is drawn through conduit 40, a vacuum valve 24 is provided. Vacuum valve 24 includes a pneumatic actuator controlled through ports 32 and 33 which are connected to a pressurized air source through conduits 28 and 26 respectively. In this manner, a vacuum source can be connected at end 30 of conduit 40 through a coupling 31. The vacuum source can be turned on prior to the time at which it is desired to draw a vacuum through conduit 40, to enable the vacuum to reach its full operating capacity. Then, when it is desired to draw the vacuum through conduit 40, pressurized air is introduced into port 28 to cause valve 24 to open. When it is desired to terminate the vacuum in conduit 40, pressurized air is introduced through port 26 to shut valve 24 off. The vacuum source attached at end 30 of conduit 40 can comprise a venturi or any other well known vacuum source.

Figure 4:
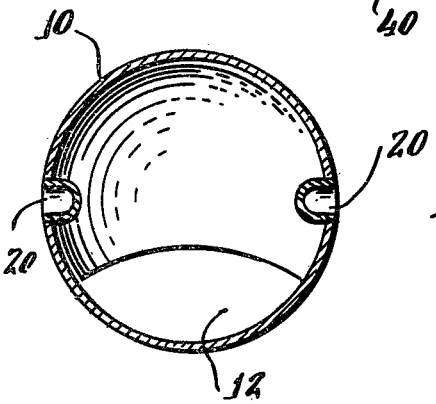
FIG. 4 is a cross-sectional view taken substantially along the line 4—4 shown in FIG. 2.

The cross-section shown in FIG. 4 clearly shows the nozzle opening 12 and ports 20 which supply the low pressure air externally of tube 10.

By providing a nozzle with an opening that directs the flow of particulate material through the slit in a slitted valve sleeve, in combination with a high pressure air blast to clear the nozzle after filling, a low pressure air vent to suspend particles remaining in the valve sleeve after filling, and a vacuum to withdraw the suspended particles from the valve sleeve, the filling nozzle of the present invention achieves a dustless, spill-proof and leakproof bag filling operation.

I claim:

1. A filling nozzle for use with a valve bag, a source of particulate material, a source of high pressure air, a source of low pressure air and a source of vacuum, the valve bag having a tubular configuration including top and bottom ends, with the bottom end of said bag being closed and with the top end thereof including a tubular filling valve having a slit disposed on the bottom surface thereof opposed to the top end of the bag and in communication with the interior of the bag, the filling nozzle comprising:

an elongated member for insertion into the filling valve, the elongated member having a material passage therethrough;

means for coupling one end of said passage to the source of particulate material;

means at the other end of said passage forming an opening for directing flowing particulate material from said passage through the slit in the filling valve and into the interior of the bag;

high pressure conduit means in communication with said source of high pressure air and with said material passage;

low pressure conduit means in communication with said low pressure air;

ports for injecting low pressure air from said source of low pressure air into the interior of the filling valve externally of the filling nozzle when said elongated member is inserted into the filling valve; and vacuum suction passage in communication with said source of vacuum and with said material passage, whereby after the bag has been filled with particulate material, high pressure air from said source of high pressure air clears any remaining particulate material from said material passageway, after which low pressure air from said source of low pressure air is directed into the filling valve to suspend any particulate material remaining in the valve and after which the vacuum removes the suspended particulate material from the filling valve as the nozzle is removed therefrom.

2. The filling nozzle of claim 1 further comprising:

an inflatable boot surrounding a portion of said elongated member; and means for coupling said boot to a pressurized fluid source for inflation of the boot.

3. The filling nozzle of claim 2 wherein said boot comprises rubber.

4. The filling nozzle of claim 1 wherein said low pressure conduit means comprises a plurality of conduits running along the interior of said elongated member, and wherein said ports are in communication with said conduits and are disposed adjacent said elongated member.

5. The filling nozzle of claim 4 further comprising:

an inflatable boot surrounding a portion of said elongated member; and means for coupling said boot to a pressurized fluid source for inflation of the boot.

6. The filling nozzle of claim 5 wherein said boot comprises rubber.

* * * * *